US005289790A

United States Patent [19]

Tseng

[11] Patent Number: 5,289,790

[45] Date of Patent: Mar. 1, 1994

[54] SEWING MACHINE PRESSER FOOT HAVING MEANS OR POSITIONING SPRING ELEMENT

[76] Inventor: Hsien-Chang Tseng, P.O. Box 63-151, Taichung, Taiwan

[21] Appl. No.: 69,823

[22] Filed: Jun. 1, 1993

[51] Int. Cl.[5] ..... D05B 29/06

[52] U.S. Cl. ..... 112/235

[58] Field of Search ..... 112/235, 240, 151

[56] References Cited

U.S. PATENT DOCUMENTS 1,066,257 7/1913 Curran ..... 112/235
1,339,121 5/1920 Moffatt ..... 112/235
3,800,720 4/1974 Niino ..... 112/235
4,548,145 10/1985 Hirose ..... 112/240

*Primary Examiner*—Peter Nerbun
*Attorney, Agent, or Firm*—Morton J. Rosenberg; David I. Klein

[57] ABSTRACT

A sewing machine presser foot includes a presser pivotally coupled to the presser foot, a casing secured to the presser foot, a release handle pivotally coupled to the presser foot, a presser pivotally coupled to the presser foot, a spring having one end engaged with the presser in order to depress the presser and the other end engaged in the casing. The casing and the other end of the spring are separated from the release handle such that the users will not be hurt by the spring when the users actuate the release handle.

5 Claims, 3 Drawing Sheets

SEWING MACHINE PRESSER FOOT HAVING MEANS OR POSITIONING SPRING ELEMENT

BACKGROUND OF THE INVENTION (a) Field of the Invention

The present invention relates to a sewing machine presser foot, and more particularly to a sewing machine presser foot having means for positioning a spring element.

(b) Description of the Prior Art

A typical sewing machine presser foot is disclosed in FIG. 4 and comprises a body 10, a presser 12 pivotally coupled to the body 10, a release handle 11 secured to the body 10 for positioning the presser 12 and for releasing the presser 12 in order to replace the presser 12, a stub 13 extended laterally from the body 10, and a spring 14 including a loop 140 formed in the middle portion for engaging with the stub 13, a first end 141 engaged with the presser 12 in order to press the presser 12, and a second end 142 engaged with the body 10; however, the second end 142 is located close to the release handle 11 such that the hand of the user may be easily or inadvertently hurt by the second end 142 of the spring 140 when actuating the release handle 11.

The present invention has arisen to mitigate and/or obviate the afore-described disadvantages of the conventional sewing machine presser foot.

SUMMARY OF THE INVENTION

The primary objective of the present invention is to provide a sewing machine presser foot which includes a means for positioning the spring element such that the hand of the user will not be hurt by the spring.

In accordance with one aspect of the present invention, there is provided a sewing machine presser foot comprising a body including a lateral portion, a casing secured to the lateral portion of the body and including a hollow interior, a release handle pivotally coupled to the body, a presser pivotally coupled to the body, a spring element including a middle portion pivotally coupled to the body, a first end engaged with the presser in order to depress the presser, and a second end engaged in the hollow interior of the casing, the casing and the second end of the spring element being separated from the release handle such that the users will not be hurt by the spring element when the users actuate the release handle.

Further objectives and advantages of the present invention will become apparent from a careful reading of the detailed description provided hereinbelow, with appropriate reference to the accompanying drawings.

DETAILED DESCRIPTION OF THE INVENTION

Figure 2:
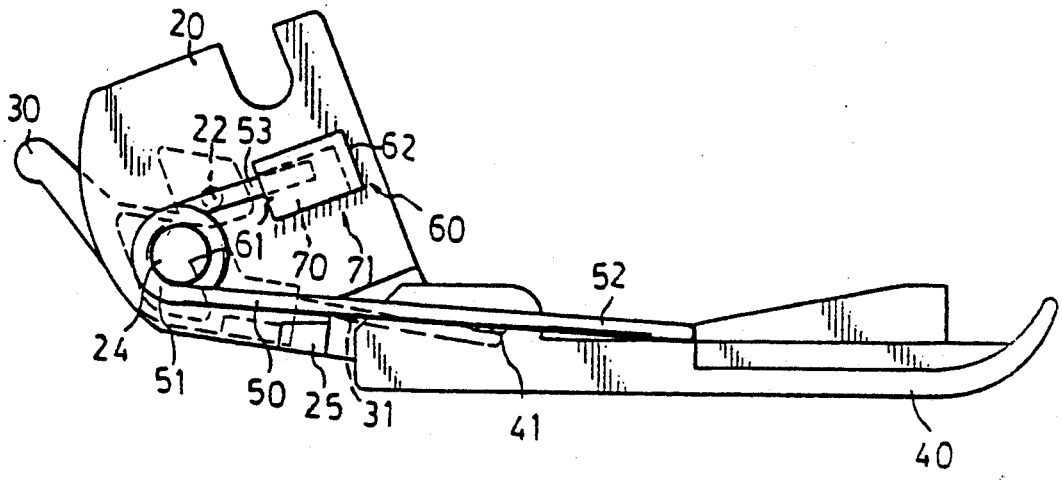
FIG. 2 is a side elevational view of the sewing machine presser foot.
Figure 1:
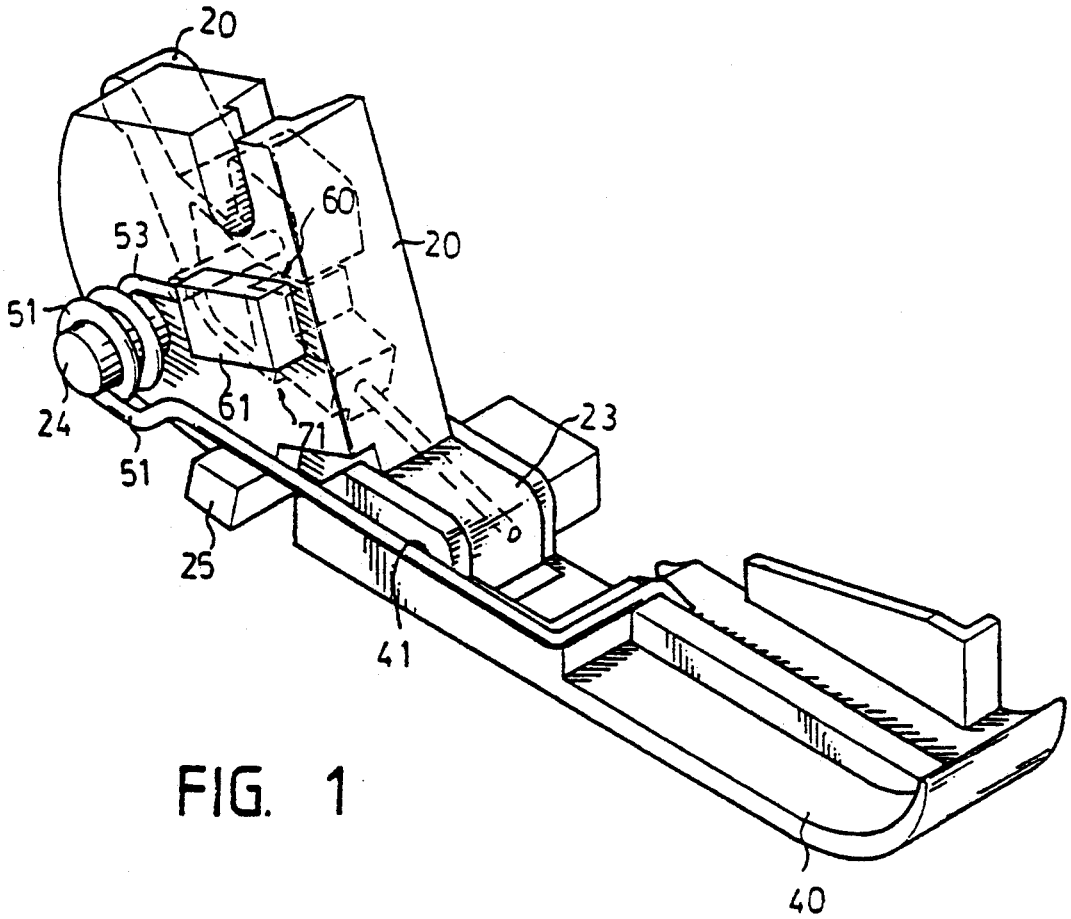
FIG. 1 is a perspective view of a sewing machine presser foot in accordance with the present invention.
Figure 3:
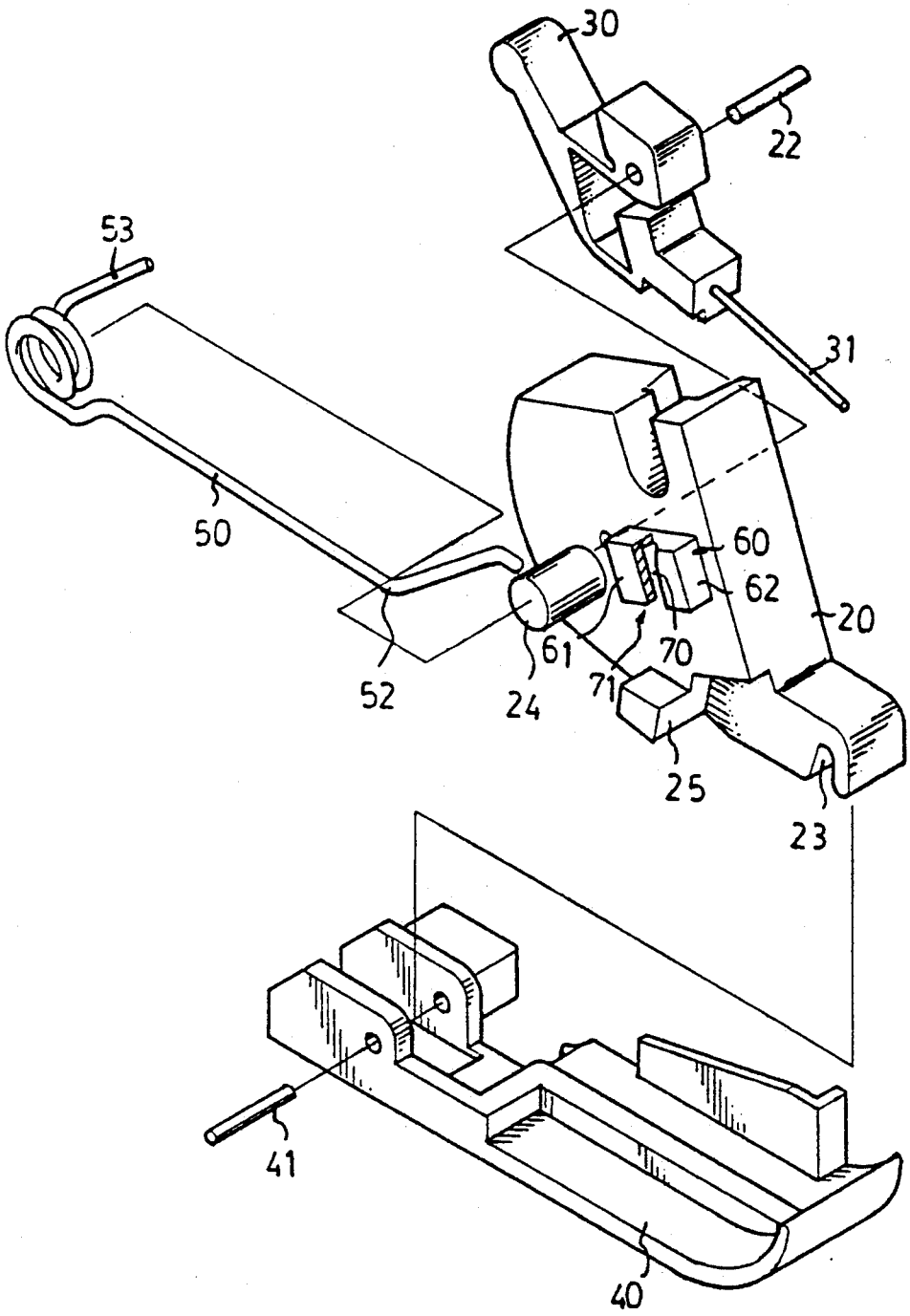
FIG. 3 is an exploded view of the sewing machine presser foot.
Figure 4:
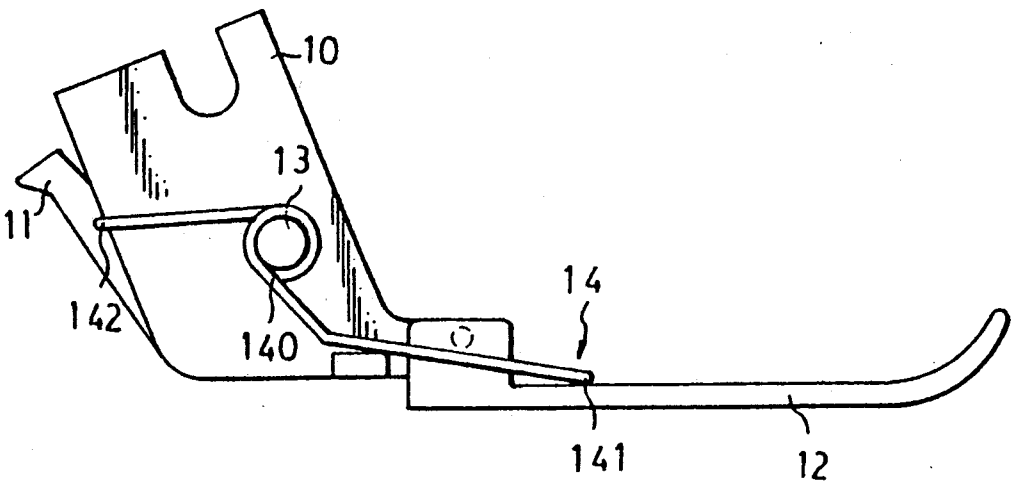
FIG. 4 PRIOR ART
FIG. 4 is a side elevational view of a typical sewing machine presser foot.

Referring to FIGS. 1 to 3, a sewing machine presser foot in accordance with the present invention comprises generally a body 20 including a stub 24 and a projection

25 extended laterally therefrom, a notch 23 formed in the front and lower portion thereof, a foot presser 40 pivotally coupled to the body 20 by a shaft 41 which is received in the notch 23 of the body 20, a handle 30 pivotally coupled to the body 20 at a pivot axle 22 and including a rod 31 extended therefrom, the rod 31 extends forward to enclose the notch 23 (FIGS. 1 and 2) such that the shaft 41 is rotatably engaged and supported in the notch 23 and such that the presser 40 is rotatable about the shaft 41. A casing 60 is secured to the lateral portion of the body 20 and includes a hollow interior 70 having a side wall 61 and a front wall 62 and an open bottom 71.

The sewing machine presser foot further includes a spring element 50 including a loop 51 formed in the middle portion for engaging with the stub 24 of the body 20, a first end 52 engaged with the presser 40 in order to depress the presser 40, and a second end 53 engaged in the hollow interior 70 of the casing 60, the second end 53 of the spring element 50 may be engaged in the casing 60 via the open bottom 71 of the casing 60. The first end portion 52 of the spring element 50 is engaged with the projection 25 such that the first end portion 52 of the spring 50 can further be stably held in place. The second end 53 of the spring element 50 is thus separated from the release handle 30 such that the hands of the users will not be hurt by the spring element 50 when the users are actuating the release handle 30.

Accordingly, the sewing machine presser foot in accordance with the present invention includes a special means for retaining the second end of the spring such that the hands of the users will not be hurt by the spring element 50 when the users are actuating the release handle 30.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sewing machine presser foot comprising a body including a lateral portion, a casing secured to said lateral portion of said body and including a hollow interior, a release handle pivotally coupled to said body, a presser pivotally coupled to said body, a spring element including a middle portion pivotally coupled to said body, a first end engaged with said presser in order to depress said presser, and a second end engaged in said hollow interior of said casing, said body including a projection extended laterally therefrom for supporting said first end of said spring element in place, said casing and said second end of said spring element being separated from said release handle such that users will not be hurt by said spring element when the users actuate said release handle.

2. A sewing machine presser foot according to claim 1, wherein said casing includes an open bottom for inserting said second end of said spring element into said hollow interior of said casing.

3. A sewing machine presser foot comprising a body including a front portion and a lateral portion, a casing secured to said lateral portion of said body and including a hollow interior, a stub extended laterally from said lateral portion of said body, a notch formed in a lower portion of said portion of said body, a presser pivotally coupled to said body at a shaft, said shaft being received in said notch of said body, a release handle pivotally coupled to said body and including a rod extended toward said notch in order to enclose said notch such that said shaft is rotatably supported in said notch of said body, a spring element including a middle portion pivotally engaged to said stub of said body, a first end engaged with said presser in order to depress said presser, and a second end engaged in said hollow interior of said casing, said casing and said second end of said spring element being separated from said release handle such that users will not be hurt by said spring element when the users actuate said release handle.

4. A sewing machine presser foot according to claim 3, wherein said body includes a projection extended laterally therefrom for supporting said first end of said spring element in place.

5. A sewing machine presser foot according to claim 3, wherein said casing includes an open bottom for inserting said second end of said spring element into said hollow interior of said casing .

* * * * *